US006866366B2

(12) United States Patent
Sasaki et al.

(10) Patent No.: US 6,866,366 B2
(45) Date of Patent: Mar. 15, 2005

(54) INKJET PRINTER AND PRINTER HEAD

(75) Inventors: Hiroshi Sasaki, Mito (JP); Makoto Kurosawa, Naka (JP); Yoshinari Suzuki, Hitachinaka (JP)

(73) Assignees: Hitachi, Ltd., Tokyo (JP); Hitachi Printing Solutions, Ltd., Kanagawa (JP)

( * ) Notice: Subject to any disclaimer, the term of this patent is extended or adjusted under 35 U.S.C. 154(b) by 39 days.

(21) Appl. No.: 10/364,403

(22) Filed: Feb. 12, 2003

(65) Prior Publication Data

US 2003/0197758 A1 Oct. 23, 2003

(30) Foreign Application Priority Data

Apr. 23, 2002 (JP) ..... 2002-121016

(51) Int. Cl.[7] ..... B41J 2/135
(52) U.S. Cl. ..... 347/45
(58) Field of Search ..... 347/45

(56) References Cited

FOREIGN PATENT DOCUMENTS

| | | | |
|---|---|---|---|
| JP | 04-339663 | | 11/1992 |
| JP | 05-169667 | | 7/1993 |
| JP | 05-254119 | | 10/1993 |
| JP | 05-338180 | | 12/1993 |
| JP | 06-340071 | | 12/1994 |
| JP | 07-101068 | | 4/1995 |
| JP | 07-266553 | | 10/1995 |
| JP | 07-276629 | | 10/1995 |
| JP | 07-290714 | | 11/1995 |
| JP | 07-304176 | | 11/1995 |
| JP | 08-108535 | | 4/1996 |
| JP | 08-118656 | | 5/1996 |
| JP | 08-230198 | | 9/1996 |
| JP | 08-238777 | | 9/1996 |
| JP | 08-267753 | | 10/1996 |
| JP | 08-318628 | | 12/1996 |
| JP | 10-219192 | * | 8/1998 |
| JP | 10-235877 | | 9/1998 |
| JP | 10-250084 | | 9/1998 |
| JP | 10-264383 | | 10/1998 |
| JP | 10-305584 | | 11/1998 |
| JP | 11-20173 | | 1/1999 |
| JP | 11-91118 | | 4/1999 |
| JP | 11-115193 | | 4/1999 |
| JP | 11-165417 | | 6/1999 |
| JP | 11-179921 | | 7/1999 |
| JP | 11-198377 | | 7/1999 |
| JP | 11-300968 | | 11/1999 |
| JP | 11-334067 | | 12/1999 |
| JP | 11-334078 | | 12/1999 |
| JP | P2000-33698 | A | 2/2000 |
| JP | P2000-43276 | A | 2/2000 |
| JP | P2001-246756 | A | 9/2001 |

* cited by examiner

*Primary Examiner*—Michael S. Brooke
(74) *Attorney, Agent, or Firm*—McDermott Will & Emery LLP

(57) ABSTRACT

An inkjet head having an ink flow path communicated with an ink chamber to an inkjet nozzle and having an orifice plate to which the nozzle is formed. An ink-philic layer is formed on the surface of the ink flow path, and an ink repellent layer is formed on the surface of the orifice plate where the nozzle is formed. The ink-philic layer is made of amorphous silica or inorganic polymer of colloidal silica bonded with a polymer of (SiOR), and the ink repellent layer contains a compound having perfluoropolyether chain and alkoxysilane residue as a terminal.

9 Claims, 4 Drawing Sheets

INKJET PRINTER AND PRINTER HEAD

FIELD OF THE INVENTION

The present invention relates to an inkjet printer, an ink head for the printer and a method for making the same.

PRIOR ART

Inkjet printers have become very much popular not only in offices, but also at homes, because they are small-sized, compared to electrophotographic printers. Image formation by inkjet printers is performed by jetting ink drops on recording medium such as paper from a nozzle or nozzles to fix the ink on the recording medium.

If ink sticks to positions near the nozzle and it is dried, new jetted ink makes contact with the dried ink to change its jetting direction. Therefore, in the conventional inkjet printers, the surface of the nozzle of the inkjet head is treated with an agent that repels ink, i.e. ink-repellent treatment. Further, there is also provided a wipe mechanism for wiping the side surface of the nozzle.

Since an ink flow path or conduit of the inkjet head is very narrow, the ink flow path may be easily clogged if the ink flow path surface is not treated properly. That is, bubbles are formed in the ink flow path so that ink is not supplied to the ink flow path. In the specification, the ink flow path or ink conduit means an area from an ink chamber to the position where no ink-repellent layer is formed.

Formation of ink-philic layers in the ink flow path has been proposed. For example, surface roughening treatment was proposed in Japanese Patent Laid-Open Print Hei4 (1992)-339663, hei8 (1996)-267753. Coating of ink-philic substances, such as ethylene glycol polypropylene glycol, or forming of an ink-philic layer by oxidation, etc. was proposed in Japanese Patent Lad-open Print Hei5 (1993)-169667, Hei5 (1993)-254119, Hei6 (1994)-340071, Hei7 (1995)-266553, Hei7 (1995)-290714, Hei7 (1995)-304176, Hei8 (1996)-118656, Hei8 (1996)-230198, Hei8 (1996)-238777, Hei8 (1996)-318628, Hei10 (1998)-235877, Hei10 (1998)-264383, Hei10 (1998)-305584, Hei11 (1999)-20173, Hei11 (1999)-91118, Hei11 (1999)-334067, Hei11 (1999)-165417, Hei11 (1999)-179921, Hei11(1999)-198377, Hei11 (1999)-334067, Hei11 (1999)-334078 and 2000-43276. Further, treatment with ozone, oxygen or oxygen plasma was proposed in Japanese Patent Laid-open Print Hei7 (1995)-101068, Hei7 (1995)-276629. Combination of the above treatments was also proposed in Japanese Patent Laid-open Print Hei8 (1996)-108535, Hei10 (1998)-250084, Hei11 (1999)-115193, Hei11 (1999)-300968 and 2000-33698.

DESCRIPTION OF THE INVENTION

Figure 1:
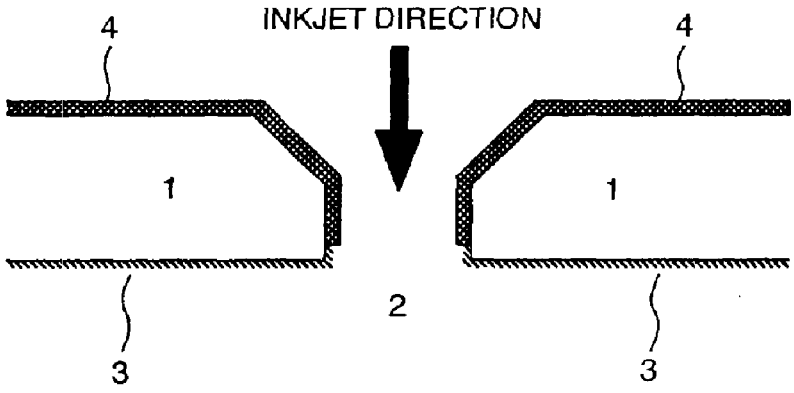
FIG. 1 is a diagrammatic view of an orifice plate according to the present invention.

The present invention provides an inkjet printer for forming images by jetting liquid ink. The printer comprises an inkjet head having an ink flow path communicated with an ink chamber to an inkjet nozzle and having an orifice plate to which the nozzle is formed, a recording medium feeder, at least a pair of roles for transferring the recording medium through the inkjet head and a controller for controlling the inkjet head, wherein an ink-philic layer is formed on the surface of the ink flow path, and an ink repellent layer is formed on the surface of the orifice plate where the nozzle is formed. The ink-philic layer contains colloidal silica bonded with $SiO_2$, and the ink repellent layer contains a compound having perfluoropolyether chain and alkoxysilane residue as a terminal. A water content of the ink-philic layer should preferably be 3 wt % or less.

The present invention provides an inkjet head having an ink flow path communicated with an ink chamber to an inkjet nozzle and having an orifice plate to which the nozzle is formed.

The present invention also provides an inkjet head, wherein the ink repellent layer containing a compound having perfluoropolyether chain and alkoxysilane residue as a terminal, a water content of the ink-philic layer being 3 wt % or less.

The present invention provides a method of manufacturing an inkjet head having an ink flow path and a nozzle from which ink is jetted, the ink flow path being communicated with an ink chamber and the nozzle, the ink flow path and the nozzle being formed in an orifice plate, which comprises forming an ink repellent layer containing a compound having a perfluoropolyether chain and an alkoxysilane residue as a terminal on a surface of the orifice plate in which the nozzle is formed, and forming an ink-philic layer containing colloidal silica bound by $SiO_2$ on the surface of the ink flow path. The ink repellent layer may contain a compound having a perfluoropolyether chain and an alkoxysilane residue as a terminal on a surface of the orifice plate in which the nozzle is formed, and a water content of the ink-philic layer is 3 wt % or less.

When printer heads are assembled after parts are treated for making them ink-philic, an adhesive percolates to the ink flow path so that the percolated portion has a high contact angle. Therefore, the treatment has to be done after assembling the parts. In this case, a coating of an ink-philic composition is proper for the treatment.

Ethylene glycol, polypropylene glycol, etc. which are liquid at room temperature vaporize after coating, thereby to loose its ink-philic property after a while. An ink-philic resin coating might be considered, but coatings of ink-philic resins such as poly(vinyl alcohol), dextrin, etc. have such a high contact angle as around 50 degrees with water. These ink-philic substances still have a high contact angle of 20 to 30 degrees with inks, though depending on compositions. Thus, when an ink flow path has a size of several ten micrometers, a better ink-philic paint or composition is desired.

Polyethylene glycol, while depending on its molecular weight, has such a small contact angle as 5 to 15 degrees with inks; therefore, this material has a sufficient ink-philic property for satisfying a size of ink flow paths of several ten micrometers. However, since polyethylene glycol is water soluble, it dissolves in inks and disappears by dissolution into ink when the ink passes through the ink flow path. Thus, such ink-philic coating compositions as being insoluble or hardly soluble in inks have been desired.

In treating printer heads with an ink-philic composition after assembling, it is practical to make a coating by filling the ink-philic composition in the ink flow path. However, since the ink-philic composition generally contains relatively a large amount of water, the composition is repelled by an adhesive that comes out to the ink flow path; therefore, the coating cannot be formed.

When the coated ink-philic paint is dried by evaporation of solvent, organic solvents vaporize at first, so that a content of water in the coating increases. Since water has a larger surface tension than organic solvents, the ink-philic composition is repelled by water.

The present inventors have tried addition of a viscosity improver such as poly(vinyl alcohol) to the ink-philic composition. There was a possibility of coating the ink-philic composition on an adhesive, but there was a problem that the ink-philic composition adhered to the surface of an orifice of an jetting nozzle when the modified composition was tried.

Since the surface of the orifice is treated with an ink repelling coating, the ink-philic paint is repelled by the surface. But, the ink-philic composition containing poly (vinyl alcohol) is also coated on the ink repellent layer.

As has been described, such an ink-philic composition that is not repelled by an adhesive in treating the ink flow path after assembling, but it is repelled by the ink repellent layer has been desired.

We have studied various methods to solve the above problem, and found that a composition should contain colloidal silica as an ink-philic material and $SiO_2$ as a binder for binding colloidal silica which is the ink-philic material. A water content of the ink-philic composition or layer should preferably be 3% by weight or less, based on the composition or layer.

The ink jet head for an ink jet printer that jets ink to make images, wherein an ink-philic layer containing colloidal silica maintained on $SiO_2$ is formed on the surface of an ink conduit, and wherein an ink repelling layer of a compound having a perfluoropolyether group and an alkoxysilane residue as the terminal in the molecule is coated on the surface of an orifice having an ink jet nozzle is coated. The ink repellent layer is formed preferably in the region by the depth of ¼ the diameter of the ink jet nozzle.

The ink jet printer that makes images by jetting ink, wherein the surface of an ink conduit is coated with an ink-philic layer of an amorphous silica layer made from colloidal silica supported on silica sol, and wherein the surface of an orifice having an ink jet nozzle is coated with an ink repellent layer containing a compound having a perfluoropolyether residue and alokoxysilane residue as a terminal in the molecule.

In the above mentioned method of making the ink jet head for the inkjet printer, after making the ink jet head, the ink-philic layer is formed by filling the ink-philic paint in an ink chamber, followed by jetting the composition into the conduit, thereby to let the composition contact with the whole conduit, and by aspirating the extra ink-philic paint with the nozzle through the ink chamber to remove the extra composition from the conduit. Then, the head is heated to dry it and to remove a solvent in the composition by evaporation, resulting in hardening of the silica sol.

PREFERRED EMBODIMENTS

1. Ink-philic Compositions (Paints), and Treating Methods, etc.

1.1 Ink-philic Compositions

The ink-philic compositions used in the present invention contain as main ingredients colloidal silica (material that exhibits intimacy with ink), silica sol to be converted into amorphous silica that supports colloidal silica after heating, and a solvent.

Mixing ratios of the ingredients depend on the structures or sizes of the ink flow path or conduits. The surface tension of the compositions should be 30 mN/m or less, so that the compositions are not repelled by adhesives made of epoxy resins, urethane resins, acrylic resins, etc. that come out into the conduit. In order to lower the surface tension of the compositions, there are several methods such as reducing water content of the compositions, using solvents having a low surface tension, etc.

In compositions using organic solvents that are mixed with water, the solvents should be azeotropic solvents, or else in drying the coating, the solvents evaporate faster than water. As a result, in the drying step the composition contains more water. Thus, even though the ink-philic composition is wet with the ink repellent coating just after coating, they repel each other as time goes.

Therefore, the water content in the coating should be as small as possible. Even when ethanol, etc. that are azeotropic with water is used, the water content should be 3% or less.

The ink-philic composition is repelled by a coating made of a compound having perfluoropolyether chains, but the ink-philic composition is not strongly repelled by other coatings made of, for example, compounds having perfluoroalkyl chains. After forming of the ink repellent coating, it is necessary to form the ink-philic coating on the ink repallent coating of perfluoropolyether compound so as to avoid reduction of the ink repellency when the ink-philic paint contacts with the ink repellent composition.

The ink-philic paint used in the present invention is repelled by the layer of compounds having perfluoropolyether chains, but not by ink repellent layers made of other compounds such as perfluoroalkyl compounds. If the ink-philic layer is formed after forming the ink repellent layer, the ink repellent layer must be made of the compound having perfluoropolyether chain, because ink repellency of the ink repellent layer will be lowered if the ink-philic paint sticks to the ink repellent layer.

(2) Solvents

Alcoholic solvents are suitable because they do not lower the dispersion property of colloidal silica and disperse silica sol. Solvents other than the alcoholic solvents that are miscible with water contained in silica sol are preferable. Such solvents that are infinitely miscible with water are more preferable. For example, methanol, ethanol, propanol, isopropanpol, etc. are preferable.

Head materials that are coated with the ink-philic composition have contact angles with water as follows: Aluminum=85–95°, SUS=70–80°, silicon=50–60°, glass=40–50°.

Among the above materials, since aluminum has the largest contact angle with water, these materials have the smallest contact angle with the ink-philic composition.

We have investigated solvents that can be coated on aluminum. As a result, there are such solvents as methanol (24.3 mN/m), ethanol (24.1 mN/m), 1-propanol (25.3 mN/m), 2-propanol (22.9 mN/m), 1-butanol (27.2 mN/m), t-butanol (22.2 mN/m), 1-pentanol (27.5 mN/m), 2-pentanol (26.0 mN/m), etc. The numbers in ( ) are surface tensions. These solvents have contact angles with aluminum of 10° or less.

Such solvents as 2-etoxy ethanol (30.6 mN/m), ethylene glycol (50.2 mN/m), diethylene glycol (47.0 mN/m), triethylene glycol (47.3 mN/m) have contact angles with aluminum of 10° or more.

From the above results, such materials as having surface tension of 30 mN/m or less are considered to be suitable for a thin coating on aluminum plate. In case of SUS or glass that has a smaller contact angle with water, solvents that have larger surface tension than the above solvents can be used. Other organic solvents such as dimethyl formamide that is highly miscible with alcoholic solvents and water can be used.

Solvents should be selected in accordance with head materials; taking into consideration the wettability between solvents and the head materials, the ink-philic composition should have a surface tension of 30 nM/m or less.

(2) Ink-philic Compositions or Paints

The present invention uses colloidal silica as a typical ink-philic material. Although colloidal silica is an aqueous dispersion of $SiO_2$ or hydrated $SiO_2$, such dispersions are not proper because a coating composition using an aqueous colloidal dispersion contains an increased amount of water. The present invention utilizes an organic dispersion of hydrated $SiO_2$ using an organic solvent so that water content can be made minimum. Solvents usable are methanol, ethanol, propanol, isoprppanol, etc, from the reasons mentioned above. Alcoholic solvents and N,N-dimethylacetamide, etc. that are well miscible with water are usable.

When silica particles in colloidal silica have an excessively large particle size, uneven surface is formed on the ink flow path, resulting in hindrance of flowing of ink. Since the width of the ink flow path is only several ten micrometers to several hundred micrometers, uneven surface in the order of submicron may have a considerable influence on the flowability of ink. Thus, an average particle size of 100 nm or less, preferably 10 to 20 nm is proper.

From the considerations mentioned above, suitable colloidal silica materials are products by Nissan Chemical Industries Ltd. under the trade names of MT-ST, IPA-ST, EG-ST, EG-ST-ZL, NPC-ST, DMAC-ST, etc.

(3) Binding Materials

A binding member for the ink-philic material such as colloidal silica in the composition is silica sol or a polymer of $\{Si(OR)_4\}$. $SiO_2$ itself cannot bind colloidal silica if the coating composition contains the binding material in the form of $SiO_2$. Therefore, the coating composition contains silica sol added as a precursor. Silica sol is a polymer of several tens to several hundreds of alkoxysilane on average. A average molecular weight is several thousands to several ten thousands. This is dissolved in water-containing alcohol. Preferable alcohol is methanol, ethanol, propanol, isopropanol, etc.

1.2 Method of Forming a Layer of the Ink-philic Paint or Composition

A method of coating the ink-philic paint on the ink conduit is as follows.

After a head is assembled, the composition is filled in an ink chamber. Then, the composition is jetted from a jet nozzle to make the composition contact whole of the conduit. Thereafter, an excessive amount of the ink composition is aspirated by the nozzle to remove it as much apossible. Then, the head is heated to dry it by evaporation of the solvent in the composition and silica sol is thermoset to form the ink-philic layer.

A temperature for curing the composition is for evaporating the solvent quickly and for curing silica sol to $SiO_2$. Evaporation of the solvent depends on solvents used. The lowest temperature for curing silica sol is at least 80° C. The temperature should be such that the damage such as deforming of the head does not occur. As a heating method, blowing hot air into the ink conduit is proper.

The ink-philic layer a kind of amorphous silica and contains a mixture of

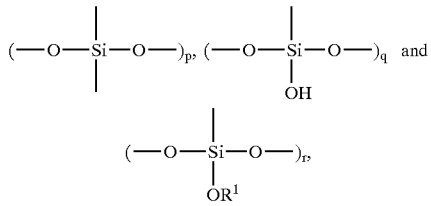

wherein p, q and r are integers of one or more, $R^1$ is an organic group such as alkyl group. These atomic groups are derived from silica sol and colloidal silica.

2. Constitution of Ink Jet Printer Heads, etc.

2.1 Orifice Plate

FIG. 1 shows a sectional view of an orifice plate. The plate 1 has a nozzle 2 for jetting ink. In the actual orifice plate of the inkjet printer, there are several tens, or even about two hundreds of nozzles. The plate that jets ink has an ink repellent layer 3 in its surface.

Further, the ink repellent layer is formed in part of the inner surface of the nozzle. This distance from the ink outlet (or, a nozzle aperture) of the nozzle member is called a "depth" in the specification.

The ink repellent layers were formed on the nozzles of different sizes and on inner surfaces at different depths, and we have conducted jetting tests using the nozzles. As a result, a desired amount of the ink composition was jetted when the depth was ¼ or less from the outlet. But, when the depth exceeds ¼, the jetting amount was decreased remarkably. This is because the ink repellent layer formed at a portion over the depth of ¼ on the inner surface of the nozzle suppresses the ink jetting.

The ink-philic layer 4 is formed on the surface where no ink repellent layer is formed to the ink chamber of the ink conduit.

2.1.1 Treatment for Ink Repelling

Preferable materials for ink repelling treatment are compounds having a perfluoropolyether chain and an alkoxysilane residue as a terminal in the molecule. The compounds form an ink repellent layer that repels the ink-philic composition that is formed after the ink repellent layer is formed, thereby to suppress the forming of the ink-philic layer in the region of the ink repellent layer. That is, it is possible to control the both regions.

Ink repellent compounds mentioned above are exemplified as follows.

$[F\{CF(CF_3)—CF_2O\}_n—CF(CF_3)]—X—Si(OR)_3$ $[F\{CF(CF_3)—CF_2O\}_n—CF(CF_3)]—X—Si(OR)_2R$ $\{F(CF_2CF_2CF_2O)_n\}—X—Si(OR)_3$ $\{F(CF_2CF_2CF_2O)_n\}—X—Si(OR)_2R$ $[F\{CF(CF_3)—CF_2O\}_n]—CF(CF_3)—X—Si(OR)_3$ $[F\{CF(CF_3)—CF_2O\}_n]—CF(CF_3)—X—Si(OR)_2R$ $\{F(CF_2CF_2CF_2O)_n\}_2—X—Si(OR)_3$ $\{F(CF_2CF_2CF_2O)_n\}_2—X—Si(OR)_2R$

X is a group for bonding the perfluoropolyether chain and the alcoxysilane residue. An example of X is a group for connecting perfluoropolyether chain and alkoxysilane terminal, such as $—CONH—(CH_2)_3—$, $—CO_2—(CH_2)_3$, $—CH_2O—(CH_2)_3—$. R is an alkyl group of carbon atoms of 1 to 4. n is an integer of at least 1, preferably 1 to 5. n in the formulae is from about 10 to 50.

Figure 2:
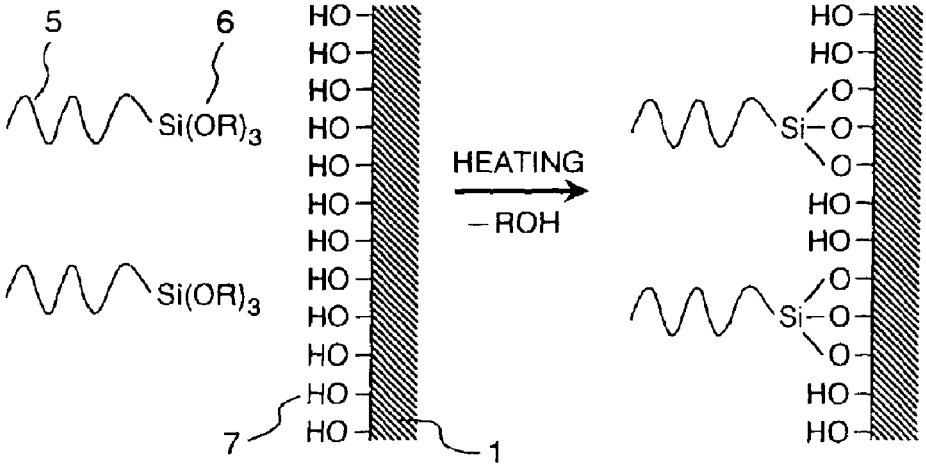
FIG. 2 shows a diagrammatic view of the bonding mechanism between an ink repellent composition and the surface of the orifice plate.

Since the treating materials repel the ink-philic composition, the ink repellent layer formed on the surface of the orifice repels the ink-philic layer that is formed after the forming of the ink repellent layer. Therefore, the ink repellent layer prevents the formation of the ink-philic layer that is to be formed on the region of the ink repellent layer. FIG. 2 shows the bonding condition of the ink repellent layer and the surface of the orifice plate.

In the molecular structure of the compounds mentioned above, the repeating units $—CF(CF_3)CF_2—$ or $—CF_2CF_2CF_2O—$ are the functional position that exhibits the ink repellent property of perfluoropolyether chain 5. The ink repellent property of this position is effective to water base ink and oil based ink.

The reduction of ink repellent property of the ink repellent layer by rubbing of its surface with a solid body is smaller than compounds having a perfluoroalkyl chain.

The alkoxysilane group represented by $Si(OR)_3$ group 6 reacts with hydroxyl groups 7 on the surface of the orifice plate 1 to form —O—Si—O— bonds as shown in FIG. 2. As a result, the ink repellent layer on the surface of the orifice plate is formed.

When the compounds have an alkoxysilane tresidues represented by $—Si(OR)_2R$, the group —OR react as same as $Si(OR)_3$, but R does not. Therefore, ink repellents having many hydroxyl groups as possible can bond firmly on the surface of the orifice plate so that the layer of better ink repellent property layer can be expected.

In the following there are explained synthetic methods of ink repellents that are encompassed in the above category.

Compound 1:

$F\{CF(CF_3)-CF_2O\}_n—CF(CF_3)-CONH—(CH_2)_3—Si(OCH_2CH_3)_3$

Compound 2:

$F\{CF(CF_3)-CF_2O\}_n—CF(CF_3)-CONH—(CH_2)_3—Si(OCH_3)_3$

Compound 3:

$F\{CF_2CF_2CF_2O\}_n—CF_2CF_2—CONH—(CH_2)_3—Si(OCH_2CH_3)_3$

Compound 4:

$F\{CF_2CF_2CF_2O\}_n—CF_2CF_2—CONH—(CH_2)_3—Si(OCH_3)_3$ (Synthesis of Compound 1)

25 Parts by weight of Krytox 157FS-L manufactured by duPont (average molecular weight; 2500) was dissolved in 100 parts by weight of PF-5080 manufactured by 3M Co., and then 20 parts by weight of thionyl chloride was added to the solution.

The solution was circulated for 48 hours under stirring. Thionyl chloride and PF-5080 were vaporized by means of an evaporator to obtain 25 parts by weight of chloroformate of Krytox 167FS-L.

100 Parts by weight of PF-5080, 3 parts by weight of Saira Ace S330 manufactured by Chisso Co., Ltd. and 3 parts by weight of triethylamine were added to the chloroformate, and then the solution was stirred for 20 hours at room temperature.

The reaction product was filtered with Radiolite Fine Flow A made by Showa Chemical Industries, Co. PF-5080 in the filtered liquid was vaporized to obtain 20 parts by weight of compound 1.

(Synthesis of Compound 2)

The process of synthesis of compound 1 mentioned above was carried out to produce 20 parts by weight of compound 2, except that 3 parts by weight of Saira Ace S360 was used for Saira Ace S330.

(Synthesis of Compound 3)

The process of synthesis of compound 1 was carried out to produce 30 parts by weight of compound 3, except that 35 parts by weight of Demnum SH, an average molecular weight; 3500, manufactured by Daikin Kogyo, K.K. was used for 25 parts by weight of Krytox 157FS-L.

(Synthesis of Compound 4)

The process of synthesis of compound 1 was carried out to produce 30 parts by weight of compound 4, except that 3 parts by weight of Saira Ace S360 was used for Saira Ace S330, and 35 parts by weight of Demnum SH, an average molecular weight 3500 was used for Krytox 157 FS-L.

If compounds have more than one perfluoropolyether chain in the molecules, the compounds have increased scraping durability. In the following, there are shown several examples of compounds having more than one perfluoropolyether chain.

$[F\{CF(CF_3)—CF_2O\}_n]CF(CF_3)—X—Si(OR)_3$ $[F\{CF(CF_3)—CF_2O\}_n]CF(CF_3)—X—Si(OR)_2R$ $[F\{CF_2CF_2CF_2O\}_n]_2—X—Si(OR)_3$ $[F\{CF_2CF_2CF_2O\}_n]_2—X—Si(OR)_2R$

In the above formulae, X is a group for bonding the perfluoropolyether chain and the alkoxysilane residue; an example for X is a group for connecting perfluoropolyether chain and alkoxysilane terminal, such as $—CONH—(CH_2)_2—N(CO)—(CH_2)_3—$. R in the above formulae is an alkyl group having carbon atoms of 1 to 4; and n is an integer of at least 1, preferably 1 to 5. n in the formulae is from about 10 to 50.

Methods of preparing compounds 5 to 8 that belong to the above formulae are described below.

Compound 5;

$$F\{CF(CF_3)-CF_2O\}_n-CF(CF_3)-CONH-(CH_2)_2-\underset{\underset{F\{CF(CF_3)-CF_2O\}_n-CF(CF_3)-CO}{|}}{N}-(CH_2)_3-Si(OCH_3)_3$$

Compound 6;

$$F\{CF(CF_3)-CF_2O\}_n-CF(CF_3)-CONH-(CH_2)_2-\underset{\underset{F\{CF(CF_3)-CF_2O\}_n-CF(CF_3)-CO}{|}}{N}-(CH_2)_3-Si(OCH_3)_2CH_3$$

Compound 7;

$$F\{CF_2CF_2CF_2O\}_n—CF_2CF_2—CONH—(CH_2)_3-\underset{\underset{F\{CF_2CF_3CF_2O\}_n—CF_2CF_2—CO}{|}}{N}—(CH_2)_3—Si(OCH_3)_3$$

Compound 8;

$$F\{CF_2CF_2CF_2O\}_n—CF_2CF_2—CONH-(CH_2)_3-\underset{\underset{F\{CF_2CF_3CF_2O)_n—CF_2CF_2—CO}{|}}{N}-(CH_2)_3—Si(OCH_3)_2CH_3$$

(Synthesis of Compound 5)

25 Parts by weight of Krystox 157 FS-L, an average molecular weight 2500 was dissolved in 100 parts by weight of PF-5080, and then 20 parts by weight of thionyl chloride was added to the solution. The solution was circulated under stirring for 48 hours to obtain 25 parts by weight of chloroformate of Krytox 157 FS-L by evaporating thionyl chloride and PF-5080.

100 Parts by weight of PF-5080, 2 parts by weight of Saira Ace S320 and 3 parts by weight of triethylamine were added to the solution, and the solution was stirred at room temperature for 20 hours.

The reaction product was filtered with Radiolite Fine Flow A. PF-5080 in the filtered liquid was evaporated by means of an evaporator to obtain 20 parts by weight of compound 5.

(Synthesis of Compound 6)

The process for making compound 5 was carried out, except that 2 parts by weight of Saira Ace S310 was used instead of Saira Ace S320, to produce 20 parts by weight of compound 6.

(Synthesis of Compound 7)

The process for making compound 5 was carried out, except that 35 parts by weight of Demnum SH (average molecular weight 3500) was used instead of Krytox 157FS-L.

(Synthesis of Compound 8)

The process for making compound 5 was carried out, except that 2 parts by weight of Saira Ace S310 and 35 parts by weight of Demnum SH were used instead of Saira Ace S320 and Krytox 157FS-L.

The average molecular weight of the ink repellent agent that depends on the length of perfluoropolyether chain and the number of the perfluoropolyerther chains in the molecule is about 1,000 to about 12,000.

The thickness of the ink repellent layer is in the order of molecule level, that is about several nm. The thickness of the layer can be measured by instrument for membrane thickness measurement of non-contact type (Ellipsometer manufactured by Mizojiri Optics Co., Ltd.) or Refraction Mode of IR spectrum, wherein vibration in CF extension around 1200 kaysers was measured.

According to the experiments, it was revealed that the surface treated with the ink repellent agent repels not only aqueous ink (water ink) that is easily soluble in water, but also oil ink that is insoluble or hardly soluble in water.

In a method of preparation of a solution of the ink repellent agent, the ink repellent agent is dissolved in a solvent. The solution is coated on the orifice plate by brush coating, spray coating, spin coating, dip coating, etc. The coating is heated to cause the alkoxysilane residues of the ink repellent agent and hydroxyl groups react with each other, resulting in chemical bonding of the ink repellent agent and the surface of the orifice plate. The ink repellent layer is thus formed.

When the ink repellent agent used in the present invention contacts with water, it is hydrolyzed. The agent should enter the nozzle of 10 to 50 ìm in diameter. Therefore, the ink repellent agent should meet the following criteria:

1) The solvent for the preparation of the ink repellent solution should have a small water content.
2) Florine containing solvents that have small surface tension are preferred.

The following compounds are examples for the solvents. FC-72, FC-77, PF-5060, PF-5080, HFE-7100, HFE-7200, manufactured by 3M Co.

Vertril XF Manufactured by duPont

X represents a group connecting the perfluoropolyether chain and alkoxysilane residue. The structure of this group is not limited, but the group should have a structure that is not subjected to hydrolysis even when an ink which has slight alkalinity is used. In this sense, X are preferably amide groups or ether groups. Molecules having ester group and ion conjunction are not preferable.

Methods of making the ink repellent layers are one using tape and a method using a water soluble resin. There is another method wherein after the ink repellent layer is formed on the whole surface of the orifice, unnecessary portion of the layer is removed by plasma ashing or by a physical method such as sandblast.

The depth of the ink repellent layer is defined as the distance from the surface of the nozzle (outlet of the nozzle) to the inside of the nozzle. The depth should be less than ¼ the diameter of the nozzle. If the depth exceeds ¼, there is a tendency that ink jetting is suppressed.

2.1.2 Material for Orifice Plate

Materials for the orifice plate will be described in detail. It is desirable that the orifice plate has hydroxyl groups as many as possible so that the orifice plate reacts with the ink repellent agent. Metallic materials are preferable. Particularly, metallic materials containing large amounts of iron, chromium, etc. are preferable. Silicon is another example for orifice plate material.

If an ink composition is aqueous, moisture tends to dissolve into the ink more easily than in an oil ink composition. This may lead to corrosion of the nozzle. Thus, materials for the orifice plate should preferably be stainless steels, in view of anti-corrosion.

Austenite stainless steels are, for example, SUS 201, SUS 202, SUS 301, SUS 303, SUS 303Se, SUS 304, SUS 304L, SUS 304N1, SUS 304N2, SUS 304LN, SUS 305, SUS 309S, SUS 310S, SUS 316, SUS 316L, SUS 316N, SUS 316LN, SUS 316J1, SUS 316J1L, SUS 317, SUS 317L, SUS 317J1, SUS 321, SUS 347, SUS XM7, SUS XM15J1, and SUS 329J1.

Ferrite stainless steels are, for example, SUS 405, SUS 410L, SUS 430, SUS430F, SUS 434, SUS 447J1, and SUS XM27.

Martensite steels are, for example, SUS 403, SUS 410, SUS 410J1, SUS 416, SUS 420J1, SUS 420F, SUS 431, SUS 440A, SUS 440B, SUS 440C, and SUS 440F.

Precipitation hardening steels are, for example, SUS 630, and SUS 631.

If an inhibitor (rust preventive agent) is added in the ink, even corrosive iron-nickel alloys, etc. can be used.

When a material for a housing of an inkjet head is silicon wafer, and when the housing and the orifice plate is bonded with thermosetting resin adhesive, the orifice plate is preferably made of iron-nickel alloys having a composition of iron:nickel=50 to 60:50 to 35 and having linear thermal expansion coefficients close to that of silicon.

In case of non-metallic materials, hydroxyl groups can be introduced by oxygen plasma, etc. For, example, inorganic materials such as silicon wafers, zirconium oxide, or resin materials such as polyimide, polypropylene are the materials for the orifice plate.

The ink repellent treating agents used in the present invention have alkoxysilane at the terminal of the molecule. This terminal group chemically reacts with metal or silicon to hold the ink repellent layer having the perfluoropolyether chain. Therefore, preferable material for the orifice plate is metal or silicon. If the orifice plate is made of resin, it has almost no reaction points with alkoxysilane on its surface, the ink repellent agent cannot react with the orifice plate; as a result, it is difficult to control an area where the ink repellent layer is formed. Further, if the resin is poor in heat resistance, it may be deformed when it is subjected to heat for reacting with alkoxysilane group. Thus, resin material is not proper for the orifice plate.

2.2 Inkjet Head

Figure 3A:
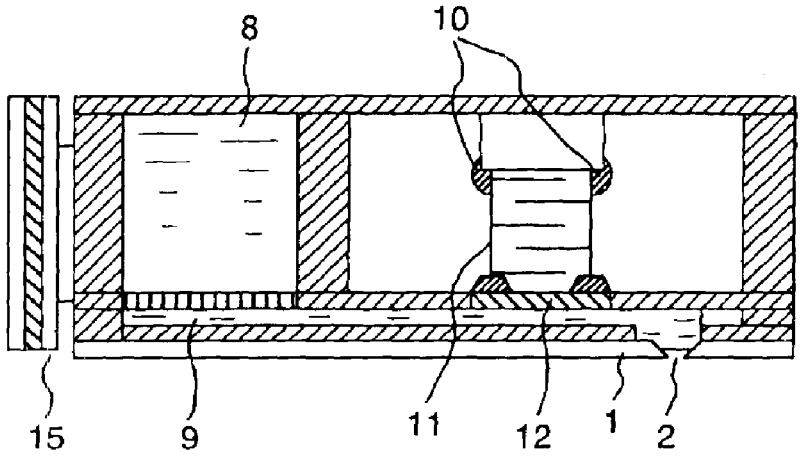
FIG. 3(*a*) is a sectional view of an inkjet head of the present invention, and FIG. 3(*b*) is a top plane view of the orifice plate shown in FIG. 3(*a*).
Figure 3B:
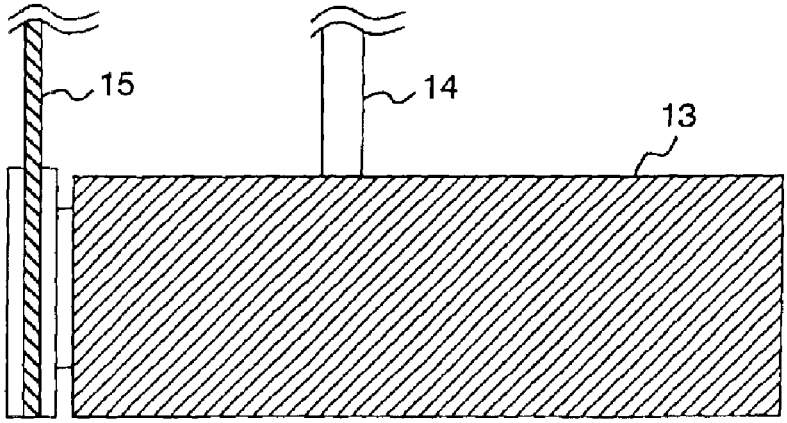

FIG. 3(*a*) shows a sectional side view of an inkjet head according to the present invention, and FIG. 3(*b*) is a top plane view of the inkjet head shown in FIG. 3(*a*).

Ink is filled in ink chamber 8. Ink is filtered by means of ink filter 9, and filtered ink fills the ink flow path 24.

Inkjet process is carried out as follows. At first, electric signals from an electronic device, such as a personal computer or a controller not shown in FIG. 3(*a*) and FIG. (b) are sent to piezoelectric element 11 through electrode 10. The piezoelectric element 11 starts compression-expansion movement, and this movement drives diaphragm 12 through the connecting portion between piezoelectric element 11 and diaphragm 12. Then, ink in the ink flow path between the ink chamber and nozzle 2 is pushed out to perform ink jetting.

Inkjet head 13 jets out ink, while the head travels on guide rail 14. The inkjet head is moved by belt 15.

2.3 Inkjet Printer

Figure 4A:
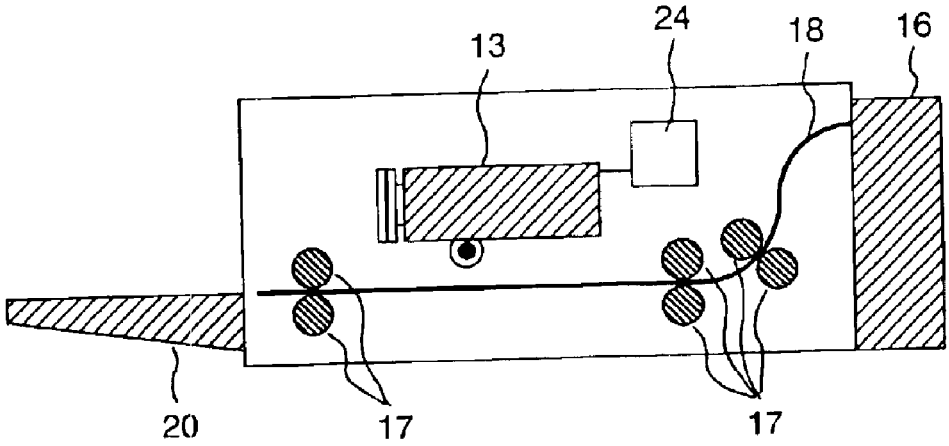
FIG. 4(*a*) shows a diagrammatical sectional view of an inkjet printer of the present invention, and FIG. 4(*b*) is a top plane view of the inkjet printer shown in FIG. 4(*b*).
Figure 4B:
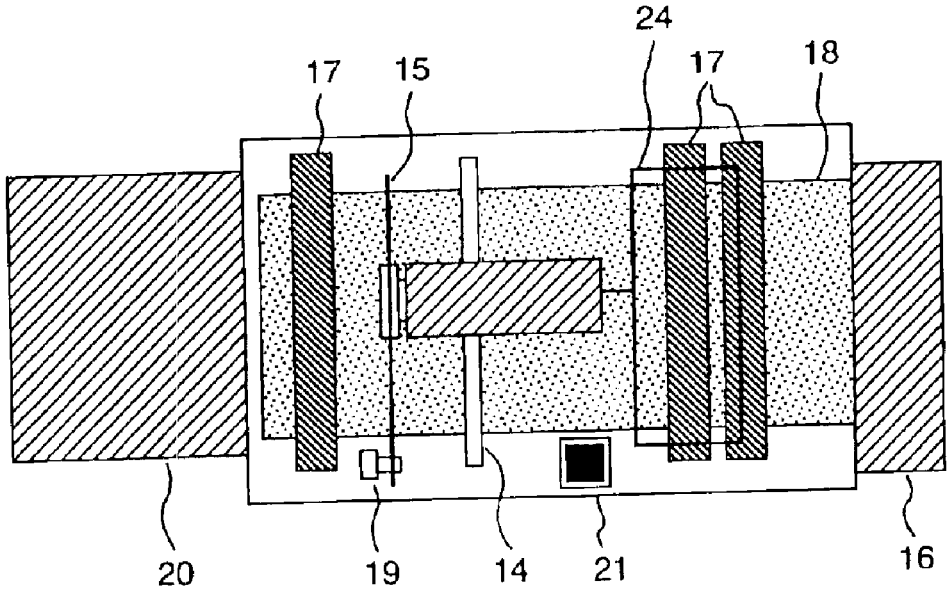

FIG. 4(*a*) is a diagrammatic sectional view of an inkjet printer according to the present invention, and FIG. 4(*b*) is a top plane view of the inkjet printer shown in FIG. 4(*a*).

Inkjet head 13 that is controlled by controller 24 in response to signals from a device such as a personal computer jets out ink towards recording medium 18 such as paper or transparent sheet for overhead projector transferred by several pair of paper sending rolls 17 from recording medium feeder 16 to form images on paper 18. Inkjet head 13 is moved on guide rail 14 through belt 15 by means of driving motor 19.

Paper on which the images are formed is transferred to paper receiving tray 20. In order to remove ink remaining on the orifice plate, the orifice plate is made rub silicone rubber plate 21.

In the following, the present invention will be explained in detail by way of Examples. The scope of the present invention should not be limited to these examples.

EXAMPLE 1

Figure 5:
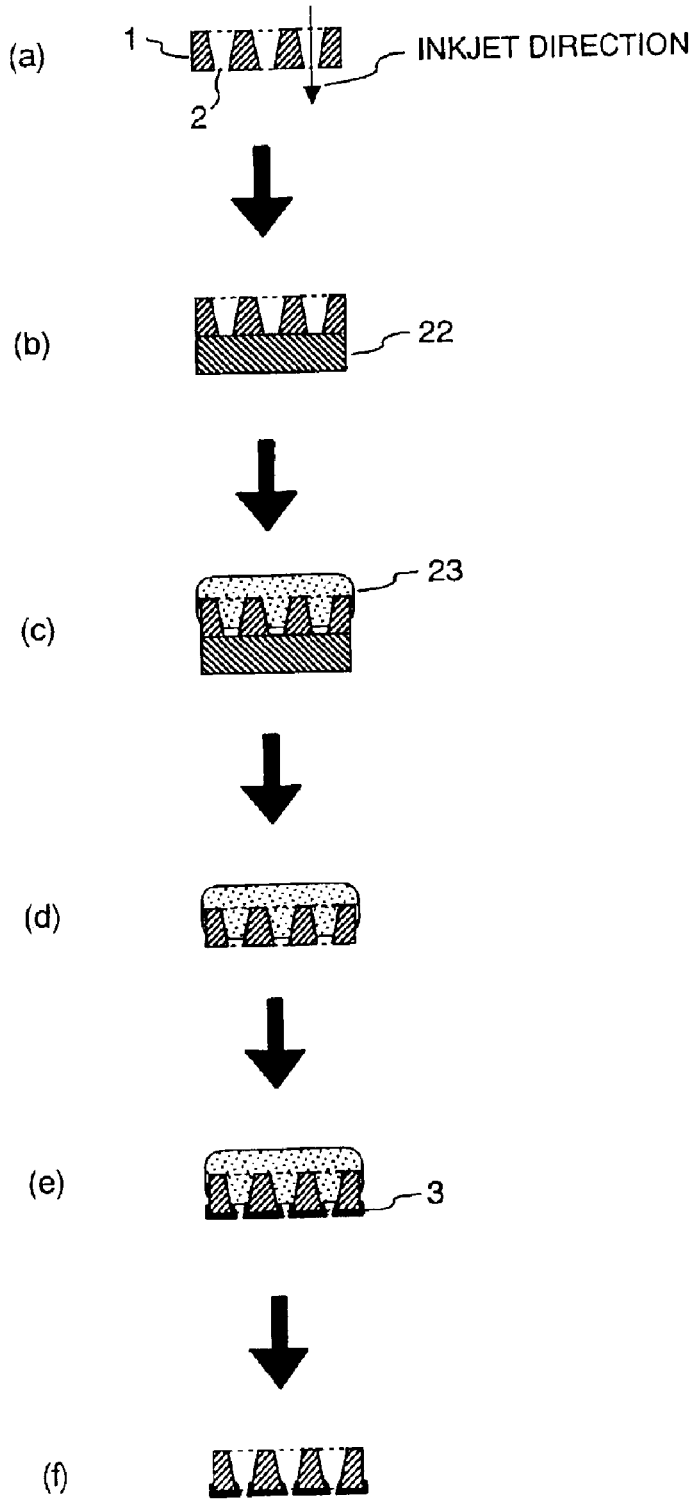
FIG. 5 is a flow chart of a method of forming the ink repellent layer on the orifice plate.

A method of forming an ink repellent layer on the orifice plate is described in the following. An outline of this process is shown in FIG. 5. In the following, the face that has a jetting nozzle is called a main face, and the opposite face is called a rear face.

An orifice plate made of SUS 304 having a nozzle outlet of 40 ìm and a thickness of 80 ìm was prepared. The structure is shown in step (a) of FIG. 5. Tape No. 966 manufactured by 3M Co. as masking tape 22 was stuck on the main face, and then a pressure of $1.0\times10^5$ kg/m$^2$ was applied thereto for 30 seconds as shown in step (b) of FIG. 5.

Thereafter, a 15 wt % aqueous solution of poly(vinyl alcohol) (the number of repeating units is 1500) was coated on the rear face. The coating was dried at room temperature to vaporize water solvent, resulting in a mask layer 23 as shown in step (c) of FIG. 5.

The depth of forming the ink repellent layer in the inkjet nozzle is adjusted by controlling a thickness of the masking tape 22, viscoelasticity, the pressure to the masking tape, etc.

In the present invention, a preferable depth of the ink repellent layer is no larger than ¼ the diameter of the inkjet nozzle from the nozzle outlet or nozzle aperture. The minimum depth of the ink repellent layer is about 1/15 the diameter of the nozzle aperture. A preferable depth may be 1/10 to ⅙ the diameter of the nozzle aperture.

The masking tape was pealed off as shown in step (d) of FIG. 5, and then it was dipped in a solution (concentration of 0.5 wt %) of PF-5080 for 10 minutes. Further, it was heated at 120 for 20 minutes to form the ink repellent layer 3 as shown in step (e) of FIG. 5.

Then, the orifice plate was put in water of 80 in a beaker. The beaker was shaken by an ultrasonic cleaner for ten minutes. Water was replaced, followed by vibration with the ultrasonic vibration cleaner. Thereafter, this procedure was repeated 4 times to remove the masking as shown in step (f) of FIG. 5. Thus, the orifice plate having an inkjet nozzle on which an ink repellent layer is formed.

A contact angle of the ink repellent layer with water was 115 to 117°, and a contact angle with ink (surface tension: 50 mN/m) for image formation was 90 to 92°. A thickness of the ink repellent layer measured by the ellipsometer was 4 to 5 ìm.

The orifice plate was fixed to the inkjet head shown in FIG. 3 by an adhesive No. 2210 manufactured by 3-Bond Ltd., and the inkjet head was installed on the inkjet printer shown in FIG. 4(*a*) and FIG. 4(*b*).

An ink-philic composition was prepared by mixing silica sol solution (concentration 6 wt %, pH of the sol was adjusted to 3 to 4 with nitric acid), 1 part by weight of colloidal silica (Snow Tex IPA-ST manufactured by Nissan Chemical Industries, Ltd.) and 20 parts by weight of ethanol.

The above ink-philic composition was filled in the ink chamber of the inkjet head, and then the composition was jetted out from all of the nozzles. An amount of jetting was 100 pico-liters per nozzle per time. The number of jetting times was 10. Thus, the ink-philic composition was contacted with the ink chamber through the ink flow path. Thereafter, hot air of 100 was introduced into the ink chamber so as to form the ink-philic layer.

The ink-philic composition is repelled by the ink repellent layer on the orifice plate. Therefore, the ink-philic layer is not formed on the ink repellent layer.

No. 2210, an adhesive manufactured by 3-Bond was coated on SUS 301 plate and heated to thermoset. A contact angle of the adhesive coating with water was about 90°. SUS 304 plate had a contact angle with water was about 75°.

Then, the ink-philic composition was coated on the adhesive coating. The composition was not repelled by the adhesive. The ink-philic layer had a contact angle with water of 20° or less. That is, it was able to form the ink-philic layer on the adhesive coating.

Finally, ink was filled in the ink chamber, followed by forming of printing images. It was revealed that ink was ejected from all of the jet nozzles.

From the above description, it is apparent that the inkjet printer that is provided with the inkjet head having the ink-philic layer was able to jet out a desired amount of ink and that stable forming of printing images was possible.

EXAMPLE 2

Example 1 was carried out, except that in preparing an ink-philic composition, Snow Tex IPA-ST as colloidal silica was changed to MT-ST. IPA-ST contains isopropanol as a solvent, but MT-ST contains methanol as a solvent.

The ink-philic materials in this example is repelled by the ink repellent layer and is not coated with the ink repellent material. The ink-philic material can be coated on the adhesive, and can form an ink-philic layer having a contact angle with water of about 20°.

After the forming of the ink-philic layer, ink was filled in the ink chamber, and printing of images was carried out. Ink was jetted out from all of the nozzles to form desired images.

Accordingly, the ink-philic material for making the ink-philic layer was able to jet out desired amounts of ink even when a dispersant for colloidal silica changes from isopropanol to methanol.

EXAMPLE 3

Example 1 was carried out, except that compound 2 was used for compound 1. As a result, it was confirmed that the ink repellent material repels the ink-philic material and does not form a membrane on the ink-repellent layer. After the forming of the ink-philic layer, ink was filled in the ink chamber and printing of images was conducted. Ink was jetted out from all of the nozzles to form desired images.

From the test result, it was revealed that even when the ink repellent material is changed from compound 1 to compound 2, the inkjet head was able to jet out desired amounts of ink and that the inkjet printer according to this example was able to make images stably.

EXAMPLE 4

Example 1 was carried out, except that compound 3 was used for compound 1. As a result, it was confirmed that the ink repellent material repels the ink-philic material and does not form a coating of an ink-philic compound After the forming of the ink-philic layer, ink was filled in the ink chamber and printing of images was conducted. Ink was jetted out from all of the nozzles to form desired images.

From the test result, it was revealed that even when the ink repellent material is changed from compound 1 to compound 3, the inkjet head was able to jet out desired amounts of ink and that the inkjet printer according to this example was able to make images stably.

EXAMPLE 5

The example was carried out, except that compound 4 was used for compound 1. As a result, it was confirmed that the ink repellent material repels the ink-philic material and does not form a coating. After the formation of the ink-philic layer, ink was filled in the ink chamber and printing of images was conducted. Ink was jetted out from all of the nozzles to form desired images.

From the test result, it was revealed that even when the ink repellent material is changed from compound 1 to compound 4, the inkjet head was able to jet out desired amounts of ink and that the inkjet printer according to this example was able to make images stably.

EXAMPLE 6

Example 1 was carried out, except that compound 5 was used for compound 1. As a result, it was confirmed that the ink repellent material repels the ink-philic material and does not form a coating. After the forming of the ink-philic layer, ink was filled in the ink chamber and printing of images was conducted. Ink was jetted out from all of the nozzles to form desired images.

From the test result, it was revealed that even when the ink repellent material is changed from compound 1 to compound 5, the inkjet head was able to jet out desired amounts of ink and that the inkjet printer according to this example was able to make images stably.

EXAMPLE 7

Example 1 was carried out, except that compound 6 was used for compound 1. As a result, it was confirmed that the ink repellent material repels the ink-philic material and does not form a coating. After the forming of the ink-philic layer, ink was filled in the ink chamber and printing of images was conducted. Ink was jetted out from all of the nozzles to form desired images.

From the test result, it was revealed that even when the ink repellent material is changed from compound 1 to compound 6, the inkjet head was able to jet out desired amounts of ink and that the inkjet printer according to this example was able to make images stably.

EXAMPLE 8

The example was carried out, except that compound 7 was used for compound 1. As a result, it was confirmed that the ink repellent material repels the ink-philic material and does not form a coating. After the forming of the ink-philic layer, ink was filled in the ink chamber and printing of images was conducted. Ink was jetted out from all of the nozzles to form desired images.

From the test result, it was revealed that even when the ink repellent material is changed from compound 1 to compound 7, the inkjet head was able to jet out desired amounts of ink and that the inkjet printer according to this example was able to make images stably.

EXAMPLE 9

Example 1 was carried out, except that compound 8 was used for compound 1. As a result, it was confirmed that the ink repellent material repels the ink-philic material and does not form a coating. After the forming of the ink-philic layer, ink was filled in the ink chamber and printing of images was conducted. Ink was jetted out from all of the nozzles to form desired images.

From the test result, it was revealed that even when the ink repellent material is changed from compound 1 to compound 8, the inkjet head was able to jet out desired amounts of ink and that the inkjet printer according to this example was able to make images stably.

COMPARATIVE EXAMPLE 1

Example 1 was carried out, except that compound 1 for an ink repellent agent was changed to compound 9 of which chemical formula is shown below.

$$F(CF_2)—(CH_2)_2—Si(OCH_2CH_3)_3 \qquad \text{Compound 9;}$$

As a result, it was revealed that the compound 9 repels ink-philic compositions to same extent, but it was also found that ink-philic coating was formed on the ink repellent layer in places. After forming the ink-philic layer, ink was filled in the ink chamber to print images, but ink percolated from the nozzles, so that percolated ink stuck on printing paper.

It was discovered that the ink-philic layer was formed on the ink repellent layer, and that ink percolated through the ink-philic layer. From this result, it was revealed that although the ink-philic layer is necessary in the ink flow path, percolation of ink takes place if the ink-philic layer is formed around the nozzles or on the surface of the orifice.

The above phenomenon (ink percolation) was found in case of compound 10 shown below.

$$F(CF_2)_8—(CH_2)_2—Si(OCH_2CH_3)_3 \qquad \text{Compound 10;}$$

The compounds 9 and 10 as ink repellent agents have perfluoroalkyl chains, not perfluoropolyether chains. On the other hand, compounds 1 to 8 can repel the ink-philic layer composition so that there is no problem of ink percolation.

From the above results, it was revealed that in order to prevent forming of the ink-philic layer on the ink repellent layer, a series of the compounds 1 to 8 having perfluoropolyether chains were useful.

From Examples 1 to 9 and Comparative Example 1, it is apparent that since the ink-philic layeris repelled by the ink repellent layer, the ink-philic layer can be formed properly. Therefore, the ink-philic layer must be formed before forming of the ink repellent layer.

COMPARATIVE EXAMPLE 2

Example 1 was carried out, except that colloidal silica (Snow Tex) was changed to alumina sol (Alumina Sol No. 520).

The ink-philic composition was not coated because it was repelled by the ink repellent layer. But, it was confirmed that the former was not coated on the adhesive layer, either. An ink-philic layer for the inkjet head as disclosed in Example 1 was formed by this water-philic composition, and then ink was filled in the ink chamber to printing images. However, ink was not jetted out from almost none of the nozzles, and desired images could not be formed. A water content of the ink-philic layer was about 5 wt %.

Then, Example 1 was repeated, except that Snow Tex IPA-ST (colloidal silica) was changed to Snow Tex 30. Both of the above colloidal silica solutions are 30 wt % suspension of colloidal silica in which suspending agents were isopropanol for the former and water for the latter.

It was confirmed that the above ink-philic composition was repelled by an adhesive, and an ink-philic layer could not be formed. Using this ink-philic composition, an inkjet head similar to one shown in Example 1 was prepared. Ink was filled in the ink chamber, and printing was carried out. However, ink was not jetted out from almost none of the nozzles, and desired images could not be formed. A water content of the ink-philic layer was about 4 wt %.

EXAMPLE 10

Then, Example 1 was repeated, except that colloidal silica Snow Tex IPA-ST was changed from 1 part by weight to 0.7 part by weight. The resulting composition was repelled by the ink repellent layer, but was not repelled by the adhesive. It was also confirmed that the ink-philic layer could be formed.

An inkjet head was prepared using the above inkjet head similar to that of Example 1, and ink was filled in the ink chamber. When printing was tried using the inkjet head, ink was jetted out from all of the nozzles so that desired images were formed. A water content of the water-philic composition was found to be about 3 wt %. Note that the water content of the water-philic composition was about 1 wt %.

From the above results, it has been confirmed that the water content of the water-philic composition should be 3 wt % or less so that the composition can be coated even on percolated adhesive (3-Bond No. 2210).

Coating tests of water-philic compositions prepared in this Comparative example and Example 1 on an adhesive layer were conducted. The adhesive was No. 2275 manufactured by 3-Bond. As a result, it was confirmed that a water content of the water-philic composition that can be coated on the adhesive was 3 wt % or less.

Further, it has been revealed that inkjet heads in which ink flow paths were treated with water-philic compositions that can be coated on adhesives could jet out ink from all of the nozzles to form desired images. However, when water-philic compositions that are repelled by adhesives are used, ink could not be jetted out from almost none of the nozzles.

From the above described facts, it has been confirmed that a water content in the water-philic composition should be 3 wt % or less so that it can be coated even on percolated adhesives into ink flow paths.

According to the present invention, it is possible to provide inkjet heads capable of stable ink filing and inkjet printers capable of stable image forming. In other words, since the ink flow path is entirely covered with the ink-philic layer, no bubbles are formed in the path and ink can be jetted without any troubles.

What is claimed is:

1. An inkjet printer for forming images by jetting liquid ink, comprising an inkjet head having an ink flow path communicated with an ink chamber through an inkjet nozzle and having an orifice plate to which the nozzle is formed, a recording medium feeder, and a controller for controlling the inkjet head, wherein an ink-philic layer is formed on the surface of the ink flow path, and an ink repellent layer is formed on the surface of the orifice plate where the nozzle aperture is formed, the ink-philic layer being made of amorphous silicon layer containing atomic groups of

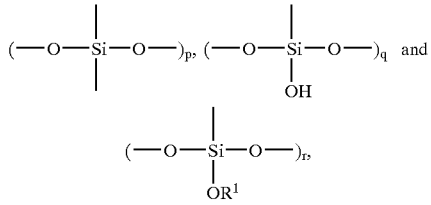

wherein p, q and r are integers of one or more, and the ink repellent layer containing a compound having a perfluoropolyether chain and alkoxysilane residue as a terminal.

2. The inkjet printer according to claim 1, wherein a water content of the ink-philic layer is 3 wt % or less.

3. The inkjet printer according to claim 1, wherein the orifice plate is made of metal or silicon.

4. The inkjet printer according to claim 1, wherein the ink-philic layer is a hardened polymeric silicon compounds.

5. An inkjet head having an ink flow path communicated with an ink chamber through an inkjet nozzle and having an orifice plate to which the nozzle is formed, wherein an ink-philic layer is formed on the surface of the ink flow path, and an ink repellent layer is formed on the surface of the orifice plate where the nozzle aperture is formed, the ink-philic layer being made of a polymeric material containing atomic groups of $—(O—Si—OH)_p$, $—(Si—O—)_q$ and $—(Si—OR—)_r$, wherein p, q and r are integers of one or more, and the ink repellent layer containing a compound having perfluoropolyether chain and alkoxysilane residue as a terminal.

6. The inkjet head according to claim 5, wherein the orifice plate is made of metal or silicon.

7. The inkjet head according to claim 5, wherein a water content of the ink-philic layer is 3 wt % or less.

8. The inkjet printer according to claim 5, wherein the ink-philic layer is a hardened polymeric silicon compounds.

9. An inkjet head having an ink flow path communicated with an ink chamber through an inkjet nozzle and having an orifice plate to which the nozzle is formed, wherein an ink-philic layer is formed on the surface of the ink flow path, and an ink repellent layer is formed on the surface of the orifice plate where the nozzle is formed, the ink-philic layer containing an inorganic layer of polymeric silica bonded with a polymer of (Si—OR), and the ink repellent layer containing a compound having perfluoropolyether chain and alkoxysilane residue as a terminal, a water content of the ink-philic layer being 3 wt % or less.

* * * * *